US009551267B2

(12) United States Patent
Shin

(10) Patent No.: US 9,551,267 B2
(45) Date of Patent: Jan. 24, 2017

(54) HEAT RESISTANT CAST STEEL HAVING SUPERIOR HIGH TEMPERATURE STRENGTH AND OXIDATION RESISTANCE

(71) Applicant: HYUNDAI MOTOR COMPANY, Seoul (KR)

(72) Inventor: Ho-Chul Shin, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/920,676

(22) Filed: Oct. 22, 2015

(65) Prior Publication Data

US 2016/0153312 A1 Jun. 2, 2016

(30) Foreign Application Priority Data

Dec. 2, 2014 (KR) ..... 10-2014-0170139

(51) Int. Cl.

| | |
|---|---|
| ***F01D 25/24*** | (2006.01) |
| ***F01N 13/10*** | (2010.01) |
| ***C22C 38/48*** | (2006.01) |
| ***C22C 38/46*** | (2006.01) |
| ***C22C 38/44*** | (2006.01) |
| ***C22C 38/04*** | (2006.01) |
| ***C22C 38/02*** | (2006.01) |
| ***C22C 38/00*** | (2006.01) |
| ***F01D 25/00*** | (2006.01) |
| ***F02B 39/00*** | (2006.01) |

(52) U.S. Cl.

CPC ..... *F01N 13/10* (2013.01); *C22C 38/001* (2013.01); *C22C 38/005* (2013.01); *C22C 38/02* (2013.01); *C22C 38/04* (2013.01); *C22C 38/44* (2013.01); *C22C 38/46* (2013.01); *C22C 38/48* (2013.01); *F01D 25/005* (2013.01); *F02B 39/00* (2013.01); *F05D 2300/171* (2013.01); *F05D 2300/176* (2013.01)

(58) Field of Classification Search

CPC ..... F01D 25/24; C22C 38/48; C22C 38/46; C22C 38/44; C22C 38/04; C22C 38/02; C22C 388/005; C22C 38/001; F01N 13/10

See application file for complete search history.

(56) References Cited

U.S. PATENT DOCUMENTS

| | | | | |
|---|---|---|---|---|
| 5,202,088 | A | 4/1993 | Genma et al. | |
| 2014/0186206 | A1* | 7/2014 | Park | C22C 38/26 420/63 |
| 2015/0259763 | A1* | 9/2015 | Sa | C21D 6/004 411/378 |

FOREIGN PATENT DOCUMENTS

| | | | | |
|---|---|---|---|---|
| DE | 102010006800 | * | 3/2011 | C22C 33/0285 |
| DE | WO 2016050379 | A1 * | 4/2016 | C22C 38/06 |
| EP | 1826288 | A1 | 8/2007 | |
| JP | 01-159354 | A | 6/1989 | |
| JP | 04-218645 | A | 8/1992 | |
| JP | 05-59498 | A | 3/1993 | |
| JP | 05-171365 | A | 7/1993 | |
| JP | 05-287457 | A | 11/1993 | |
| JP | 2007-254884 | A | 10/2007 | |
| JP | 2007-254885 | A | 10/2007 | |
| JP | 2008248385 | A * | 10/2008 | |
| JP | 2013133533 | A * | 7/2013 | |
| JP | WO 2016068009 | A1 * | 5/2016 | C21D 8/00 |

* cited by examiner

*Primary Examiner* — Patrick Maines

(74) *Attorney, Agent, or Firm* — McDermott Will & Emery LLP

(57) ABSTRACT

A heat-resistant cast steel includes, based on a total weight of the heat-resistant cast steel, 0.2 to 0.4 wt % carbon; 0.5 to 1.0 wt % silicon; 0.3 to 0.8 wt % manganese; 0.7 to 1.0 wt % nickel; 17 to 23 wt % chromium; 0.5 to 1.0 wt % niobium; 1.5 to 2.0 wt % tungsten; 0.2 to 0.5 wt % vanadium; 0.05 to 0.1 wt % cerium; 0.05 to 0.1 wt % nitrogen; and a balance of iron.

12 Claims, No Drawings

HEAT RESISTANT CAST STEEL HAVING SUPERIOR HIGH TEMPERATURE STRENGTH AND OXIDATION RESISTANCE

CROSS-REFERENCE TO RELATED APPLICATIONS

This application claims priority under 35 U.S.C. §119 to Korean Patent Application No. 10-2014-170139, filed on Dec. 2, 2014, in the Korean Intellectual Property Office, the entirety of which is incorporated herein by reference.

TECHNICAL FIELD

The present disclosure relates to a heat-resistant cast steel having superior high temperature strength and oxidation resistance, and more particularly, to a heat-resistant cast steel that may be applied to an exhaust manifold of a high performance vehicle and the like by improving high temperature strength, oxidation resistance, and the like.

BACKGROUND

Generally, an exhaust manifold refers to an exhaust pipe collecting exhaust gas discharged from each cylinder into one flow. The manifold may experience resistance because of differences in an internal diameter of a gasket, an internal diameter of a head, and an internal diameter of the manifold.

Since the exhaust manifold is placed at a site where an exhaust gas outputted from a cylinder head is first received, the exhaust manifold may be exposed to very high heat according to the power of an engine. Because there is no cooler such as cooling water in the exhaust manifold, unlike an engine having cooling water, when the engine is accelerated, the temperature may increase to about 800 to 900° C. from the high temperature exhaust gas and may then be rapidly air-cooled to normal temperature when the engine is stopped.

Since this process is repeated several times in one day, the heat impact on the exhaust manifold may be very severe, and thus high durability of the exhaust manifold among the various parts of the engine is desired.

A turbine housing is an external case of a turbo charger, and a turbine wheel and the like are in the turbine housing. Since the turbine housing is exposed to the high temperature of the exhaust gas outputted from the exhaust manifold, the turbine housing should have high durability like the exhaust manifold.

For high durability, a material used in the exhaust manifold and the turbine housing of a diesel engine, FCD-HS and SiMo cast irons and the like are used as a high-temperature oxidation-resistant cast iron. These materials are manufactured by adding an element such as silicon (Si) and molybdenum (Mo) to an existing nodular graphite cast iron material to improve physical properties and oxidation resistance at high temperatures.

However, a general-use temperature range of an exhaust system using heat-resistant cast iron is about 630 to 800° C., and in this temperature range, the aforementioned materials have tensile strength of about 60 MPa.

However, recently, due to the development of high-performance engines to meet the trend of increased output of vehicles, and also the strengthening of exhaust regulations, exhaust gas temperatures have increased. As the standard of durability and quality is strengthened, a load applied to the exhaust system is gradually increasing.

Therefore, the present disclosure has been made in an effort to develop a heat-resistant cast steel having superior strength and oxidation resistance at high temperatures to be used in an exhaust manifold and a turbine housing of a high performance engine.

SUMMARY

The present disclosure has been made in an effort to provide a heat-resistant cast steel including iron (Fe), carbon (C), silicon (Si), manganese (Mn), nickel (Ni), chromium (Cr), niobium (Nb), tungsten (W), vanadium (V), cerium (Ce), nitrogen (N), and the like in optimum contents to have superior high temperature strength and oxidation resistance and the like.

An exemplary embodiment of the present inventive concept provides a heat-resistant cast steel comprising, based on a total weight of the heat-resistant cast steel, 0.2 to 0.4 wt % carbon; 0.5 to 1.0 wt % silicon; 0.3 to 0.8 wt % manganese; 0.7 to 1.0 wt % nickel; 17 to 23 wt % chromium; 0.5 to 1.0 wt % niobium; 1.5 to 2.0 wt % tungsten; 0.2 to 0.5 wt % vanadium; 0.05 to 0.1 wt % cerium; 0.05 to 0.1 wt % nitrogen; and a balance of iron.

An exemplary embodiment of the present inventive concept may provide a heat-resistant cast steel where a content of carbon is 0.27 to 0.38 wt %; a content of silicon is 0.65 to 0.95 wt %; a content of manganese is 0.35 to 0.72 wt %; a content of nickel is 0.53 to 0.94 wt %; a content of chromium is 17.5 to 22.8 wt %; a content of niobium is 0.53 to 0.92 wt %; a content of tungsten is 1.52 to 1.86 wt %; a content of vanadium is 0.25 to 0.43 wt %; a content of cerium is 0.06 to 0.09 wt %; and a content of nitrogen is 0.05 to 0.07 wt %, based on a total weight of the heat-resistant cast steel.

An exemplary embodiment of the present inventive concept may provide a heat-resistant cast steel where a content of carbon is 0.38 wt %; a content of silicon is 0.83 wt %; a content of manganese is 0.41 wt %; a content of nickel is 0.93 wt %; a content of chromium is 22.8 wt %; a content of niobium is 0.85 wt %; a content of tungsten is 1.79 wt %; a content of vanadium is 0.43 wt %; a content of cerium is 0.08 wt %; and a content of nitrogen is 0.07 wt %, based on a total weight of the heat-resistant cast steel.

The heat-resistant cast steel may be used in an exhaust manifold, a turbine housing, an integrated exhaust manifold turbine housing for a vehicle, and the like.

The aforementioned heat-resistant cast steel of the present inventive concept can have superior physical properties such as high temperature strength and oxidation resistance to be applied to an exhaust manifold, a turbine housing, and an integrated exhaust manifold turbine housing of a high power engine requiring the superior physical properties and the like under a severe condition.

DETAILED DESCRIPTION

Terms or words used in the present specification and claims should not be interpreted as being limited to typical or dictionary meanings, but should be interpreted as having meanings and concepts which comply with the technical spirit of the present inventive concept, based on the principle that an inventor can appropriately define the concept of the term to describe his/her own inventive concept in the best manner.

Hereinafter, the present inventive concept will be described in detail. The present inventive concept relates to a heat-resistant cast steel having superior high temperature strength and oxidation resistance.

The heat-resistant cast steel according to the present inventive concept includes carbon (C), silicon (Si), manganese (Mn), nickel (Ni), chromium (Cr), niobium (Nb), tungsten (W), vanadium (V), cerium (Ce), nitrogen (N), iron (Fe), an inevitable impurity, and the like.

In more detail, based on the total weight of the heat-resistant cast steel, a content of carbon (C) may be 0.2 to 0.4 wt %, a content of silicon (Si) may be 0.5 to 1.0 wt %, a content of manganese (Mn) may be 0.3 to 0.8 wt %, a content of nickel (Ni) may be 0.7 to 1.0 wt %, a content of chromium (Cr) may be 17 to 23 wt %, a content of niobium (Nb) may be 0.5 to 1.0 wt %, a content of tungsten (W) may be 1.5 to 2.0 wt %, a content of vanadium (V) may be 0.2 to 0.5 wt %, a content of cerium (Ce) may be 0.05 to 0.1 wt %, a content of nitrogen (N) may be 0.05 to 0.1 wt %, and iron (Fe) may comprise the balance.

The heat-resistant cast steel including the aforementioned constitutional components may include carbon (C), silicon (Si), niobium (Nb), tungsten (W), vanadium (V), cerium (Ce), nitrogen (N), and the like to improve physical properties such as high temperature strength, and may include chromium (Cr), vanadium (V), cerium (Ce), and the like to improve physical properties such as oxidation resistance.

The heat-resistant cast steel according to the present inventive concept may have a ferrite matrix because the ferrite may have a thermal expansion coefficient that is smaller than that of an austenite. The ferrite may be be advantageous in use at high temperatures and a perlite may be decomposed during an increase in temperature or cooling to prevent expansion due to phase transformation.

The heat-resistant cast steel according to the present inventive concept may have a tissue where a carbide is formed in the ferrite matrix, due to the aforementioned characteristic, in the case where the heat-resistant cast steel according to the present inventive concept is applied to an exhaust manifold of a vehicle and the like, a high temperature physical property of the exhaust manifold and the like may be improved.

The exhaust manifold and the like to which the heat-resistant cast steel according to the present inventive concept is applied may be used at a temperature of about 800° C., and can endure a high temperature exhaust gas having a temperature of about 850 to 900° C.

In more detail, the reason why a numerical value of a component constituting the heat-resistant cast steel according to the present inventive concept is limited is as follows.

(1) 0.2 to 0.4 wt % of Carbon (C)

Carbon (C) performs a role of improving fluidity of a molten metal and forming a eutectic carbide with niobium (Nb) and thus improving castability and the like. For the aforementioned role, the content of carbon (C) may be about 0.2 to 0.4 wt % based on the total weight of the heat-resistant cast steel.

(2) 0.5 to 1.0 wt % of Silicon (Si)

Silicon (Si) performs a role of increasing stability of the ferrite matrix and suppressing formation of a pin hole as a deoxidizer. For the aforementioned role, the content of silicon (Si) may be about 0.5 to 1.0 wt % based on the total weight of the heat-resistant cast steel.

(3) 0.3 to 0.8 wt % of Manganese (Mn)

Manganese (Mn) performs a role of, like silicon (Si), suppressing formation of the pin hole as the deoxidizer and improving flowability of the molten metal during casting. For the aforementioned role, the content of manganese (Mn) may be about 0.3 to 0.8 wt % based on the total weight of the heat-resistant cast steel, and particularly, in the case where the content of manganese (Mn) is more than about 0.8 wt %, due to a reduction in ductility of the heat-resistant cast steel and the like, processability may be reduced and brittleness and the like may be increased.

(4) 0.7 to 1.0 wt % of Nickel (Ni)

Nickel (Ni) is used for improving a high-temperature physical property of the heat-resistant cast steel and the like, and performs a role of improving physical properties such as elongation percentage and ductility as well as high temperature strength of the heat-resistant cast steel.

However, the cost of nickel (Ni) is very high, and increasing, and thus a manufacturing cost of the heat-resistant cast steel including nickel (Ni) has been frequently changes according to the cost of nickel (Ni) and the like.

Therefore, in order to minimize the content of costly nickel (Ni) and, simultaneously, effectively improve physical properties such as high temperature strength, the content of nickel (Ni) be limited to about 0.7 to 1.0 wt % based on the total weight of the heat-resistant cast steel.

The content of nickel (Ni) is a minimum content required to improve the high temperature physical property of the heat-resistant cast steel, and other reduction in corrosion resistance, heat resistance, and the like which may occur due to nickel (Ni) in the minimum content may be supplemented by increasing the content of chromium (Cr) which has a cost that is relatively lower than that of nickel (Ni) by about 20 to 40%.

(5) 17 to 23 wt % of Chromium (Cr)

Chromium (Cr) performs a role of improving physical properties such as oxidation resistance of the heat-resistant cast steel and supplementing the role of nickel (Ni) to improve physical properties such as corrosion resistance and heat resistance as well as high temperature strength and stabilizes a matrix tissue into the ferrite. For the aforementioned role, the content of chromium (Cr) may be about 17 to 23 wt % based on the total weight of the heat-resistant cast steel.

(6) 0.5 to 1.0 wt % of Niobium (Nb)

Niobium (Nb) performs a role of improving tensile strength and the like of the heat-resistant cast steel at high temperatures by reacting with carbon (C) to form a fine carbide in the heat-resistant cast steel. For the aforementioned role, the content of niobium (Nb) may be about 0.5 to 1.0 wt % based on the total weight of the heat-resistant cast steel.

(7) 1.5 to 2.0 wt % of Tungsten (W)

Tungsten (W) performs a role of strengthening a ferrite matrix tissue and improving physical properties such as high temperature strength, and for the aforementioned role, the content of tungsten (W) may be about 1.5 to 2.0 wt % based on the total weight of the heat-resistant cast steel.

(8) 0.2 to 0.5 wt % of Vanadium (V)

Vanadium (V) performs a role of improving high temperature tensile strength, heat-resistant fatigueness, and the like and suppressing generation of a chromium (Cr) carbide to improve oxidation resistance, machinability, and the like by being reacted with carbon (C) to form a fine carbide in the heat-resistant cast steel. For the aforementioned role, the content of vanadium (V) may be about 0.2 to 0.5 wt % based on the total weight of the heat-resistant cast steel.

(9) 0.05 to 0.1 wt % of Cerium (Ce)

Cerium (Ce) performs a role of improving high temperature oxidation resistance of the heat-resistant cast steel and the like, micronizing a crystal grain at room temperature to improve physical properties such as toughness, and preventing formation of a pin hole, a gas hole, and the like. For the aforementioned role, the content of cerium (Ce) may be about 0.05 to 0.1 wt % based on the total weight of the heat-resistant cast steel. In this case, in the case where the content of cerium (Ce) is less than about 0.05 wt %, a micronization effect of the crystal grain and the like are insignificant.

(10) 0.05 to 0.1 wt % of Nitrogen (N)

Nitrogen (N) performs, like carbon (C), a role of improving high temperature strength. For the aforementioned role, the content of nitrogen (N) may be about 0.05 to 0.1 wt % based on the total weight of the heat-resistant cast steel. In this case, if the content of nitrogen (N) is more than about 0.1 wt %, precipitation of a nitride of chromium (Cr) may be induced to increase brittleness of the heat-resistant cast steel.

In the heat-resistant cast steel having the aforementioned constitution of the present inventive concept, since physical properties such as high temperature strength and oxidation resistance are superior to those of an existing ferrite cast steel or cast iron, the heat-resistant cast steel may be applied to vehicle parts requiring superior physical properties and the like under severe conditions. For example, the heat-resistant cast steel may be applied to an exhaust manifold, a turbine housing, or an integrated exhaust manifold turbine housing of a high power engine.

Meanwhile, the heat-resistant cast steel according to the present inventive concept may be appropriately manufactured by a casting method publicly known to a person with skill in the art, and more specifically, it is possible to manufacture the heat-resistant cast steel so that 0.2 to 0.4 wt % of carbon (C), 0.5 to 1.0 wt % of silicon (Si), 0.3 to 0.8 wt % of manganese (Mn), 0.7 to 1.0 wt % of nickel (Ni), 17 to 23 wt % of chromium (Cr), 0.5 to 1.0 wt % of niobium (Nb), 1.5 to 2.0 wt % of tungsten (W), 0.2 to 0.5 wt % of vanadium (V), 0.05 to 0.1 wt % of cerium (Ce), 0.05 to 0.1 wt % of nitrogen (N), iron (Fe) of a balance, an inevitable impurity, and the like are included.

EXAMPLE

Hereinafter, the present inventive concept will be described in more detail through the Examples. These Examples are only for illustrating the present inventive concept, and it will be obvious to those skilled in the art that the scope of the present inventive concept is not interpreted to be limited by these Examples.

In order to check physical properties of high temperature tensile strength and high temperature oxidation resistance of the heat-resistant cast steel according to the present inventive concept, Examples 1 to 9 and Comparative Examples 1 to 5 having the components as described in the following Table 1 were manufactured.

TABLE 1

| | C | Si | Mn | Ni | Cr | Nb | W | V | Ce | Mo | N | Fe |
|---|---|---|---|---|---|---|---|---|---|---|---|---|
| Ex. 1 | 0.35 | 0.72 | 0.35 | 0.78 | 21.5 | 0.65 | 1.67 | 0.27 | 0.08 | — | 0.06 | Balance |
| Ex. 2 | 0.35 | 0.74 | 0.38 | 0.62 | 20.0 | 0.75 | 1.52 | 0.35 | 0.07 | — | 0.05 | Balance |
| Ex. 3 | 0.31 | 0.65 | 0.40 | 0.53 | 18.5 | 0.53 | 1.58 | 0.29 | 0.06 | — | 0.06 | Balance |
| Ex. 4 | 0.38 | 0.83 | 0.41 | 0.93 | 22.8 | 0.85 | 1.79 | 0.43 | 0.08 | — | 0.07 | Balance |
| Ex. 5 | 0.28 | 0.95 | 0.67 | 0.85 | 21.5 | 0.85 | 1.68 | 0.38 | 0.07 | — | 0.06 | Balance |
| Ex. 6 | 0.30 | 0.62 | 0.53 | 0.71 | 17.5 | 0.56 | 1.59 | 0.25 | 0.09 | — | 0.05 | Balance |
| Ex. 7 | 0.31 | 0.85 | 0.58 | 0.85 | 21.5 | 0.92 | 1.78 | 0.38 | 0.06 | — | 0.06 | Balance |
| Ex. 8 | 0.29 | 0.79 | 0.65 | 0.78 | 19.8 | 0.75 | 1.83 | 0.33 | 0.08 | — | 0.06 | Balance |
| Ex. 9 | 0.27 | 0.89 | 0.72 | 0.94 | 22.0 | 0.86 | 1.86 | 0.43 | 0.07 | — | 0.07 | Balance |
| Comp. Ex. 1 | 0.30 | 0.62 | 0.53 | 0.71 | 17.5 | 0.56 | 1.56 | 0.25 | — | — | 0.05 | Balance |
| Comp. Ex. 2 | 3.10 | 3.45 | 0.50 | 0.25 | — | — | — | — | — | 0.58 | — | Balance |
| Comp. Ex. 3 | 3.15 | 4.30 | 0.20 | — | — | — | — | — | — | 0.90 | — | Balance |
| Comp. Ex. 4 | 2.10 | 4.95 | 0.55 | 36.6 | 1.85 | — | — | — | — | — | — | Balance |
| Comp. Ex. 5 | 0.2 | 2.1 | 0.8 | 2.0 | 25 | 18 | — | — | — | — | — | — |

Unit: wt %

Table 1 is a table where the constitutional components and the contents of Examples 1 to 9 satisfy the constitutional component and the content range according to the present inventive concept. Comparative Example 1 has the same constitutional component and content as Example 6 but not including cerium (Ce). Comparative Examples 2 to 4 satisfy the constitutional component and the content of the existing heat-resistant cast iron, and Comparative Example 5 satisfies the constitutional component and the content of the existing heat-resistant cast steel.

TABLE 2

| Classification | High temperature tensile strength (800° C.) | Oxidation value (800° C./200 hours) |
|---|---|---|
| Example 1 | 170 MPa | 34 mg/cm$^2$ |
| Example 2 | 180 MPa | 36 mg/cm$^2$ |
| Example 3 | 165 MPa | 30 mg/cm$^2$ |
| Example 4 | 188 MPa | 28 mg/cm$^2$ |
| Example 5 | 168 MPa | 34 mg/cm$^2$ |
| Example 6 | 160 MPa | 41 mg/cm$^2$ |
| Example 7 | 173 MPa | 36 mg/cm$^2$ |
| Example 8 | 168 MPa | 39 mg/cm$^2$ |
| Example 9 | 178 MPa | 36 mg/cm$^2$ |
| Comparative Example 1 | 150 MPa | 45 mg/cm$^2$ |
| Comparative Example 2 | 45 MPa | 250 mg/cm$^2$ |
| Comparative Example 3 | 60 MPa | 200 mg/cm$^2$ |
| Comparative Example 4 | 130 MPa | 70 mg/cm$^2$ |
| Comparative Example 5 | 140 MPa | 47 mg/cm$^2$ |

Table 2 is a table where high temperature tensile strengths and the oxidation values of Examples 1 to 9 and Comparative Examples 1 to 5 described in Table 1 are compared.

Herein, high temperature strengths were compared through the high temperature tension test based on ASTM E21 'Elevated Temperature Tension Tests of Metallic Materials' at a temperature of about 800° C. which was similar to the temperature of the exhaust system of the vehicle. A large high temperature tension test value means large high temperature strength.

High temperature oxidation resistances were compared through the oxidation value based on ASTM G111-97 'Guide for Corrosion Tests in High Temperature or High-Pressure Environment, or Both' at a temperature of about 800° C., which was similar to the temperature of the exhaust system for about 200 hours. A small oxidation value means superior oxidation resistance.

The high temperature tension test and the oxidation value were compared, and as a result, it could be seen that average high temperature tensile strength of Examples 1 to 9 was about 172.2 MPa and was higher than average high temperature tensile strength of about 105.0 MPa of Comparative Examples 1 to 5 by about 64%. It is seen that the average oxidation value of Examples 1 to 9 was about 34.9 mg/cm$^2$ and was lower than the average oxidation value of about 122.4 mg/cm$^2$ of Comparative Examples 1 to 5 by about 71.5%.

Based on the aforementioned result, it is confirmed that high temperature strength of Examples 1 to 9 were superior to that of Comparative Examples 1 to 5 by about 64%, and it was confirmed that oxidation resistance of Examples 1 to 9 was superior to that of Comparative Examples 1 to 5 by about 71.5%.

For example, it was confirmed that since the high temperature tensile strength and oxidation value values of Example 4 were higher than those of the residual Examples and Comparative Examples, Example 4 had an advantageous constitutional component and content of the heat-resistant cast steel according to the present inventive concept.

The content of the residual constitutional component of Comparative Example 1 is the same as that of Example 6, except that Comparative Example 1 does not include cerium (Ce). However, since high temperature tensile strength of Comparative Example 1 was lower than that of Example 6 by about 7% and the oxidation value was also higher than that of Example 6 by about 9%, high temperature strength of Comparative Example 1 not including cerium (Ce) was lower than that of Example 6 and particularly oxidation resistance was further lower. Thus cerium (Ce) was the element improving high temperature strength of the heat-resistant cast steel and particularly oxidation resistance.

As described above, the present inventive concept has been described in relation to specific embodiments of the present inventive concept, but the embodiments are only illustrative and the present inventive concept is not limited thereto. Embodiments described may be changed or modified by those skilled in the art to which the present inventive concept pertains without departing from the scope of the present inventive concept, and various alterations and modifications are possible within the technical spirit of the present inventive concept and the equivalent scope of the claims which will be described below.

What is claimed is:

1. A heat-resistant cast steel comprising:
based on a total weight of the heat-resistant cast steel,
0.2 to 0.4 wt % carbon;
0.5 to 1.0 wt % silicon;
0.3 to 0.8 wt % manganese;
0.7 to 1.0 wt % nickel;
17 to 23 wt % chromium;
0.5 to 1.0 wt % niobium;
1.5 to 2.0 wt % tungsten;
0.2 to 0.5 wt % vanadium;
0.05 to 0.1 wt % cerium;
0.05 to 0.1 wt % nitrogen; and
a balance of iron.

2. The heat-resistant cast steel of claim 1, wherein:
a content of carbon is 0.27 to 0.38 wt %;
a content of silicon is 0.65 to 0.95 wt %;
a content of manganese is 0.35 to 0.72 wt %;
a content of nickel is 0.53 to 0.94 wt %;
a content of chromium is 17.5 to 22.8 wt %;
a content of niobium is 0.53 to 0.92 wt %;
a content of tungsten is 1.52 to 1.86 wt %;
a content of vanadium is 0.25 to 0.43 wt %;
a content of cerium is 0.06 to 0.09 wt %; and
a content of nitrogen is 0.05 to 0.07 wt %.

3. The heat-resistant cast steel of claim 1, wherein:
a content of carbon is 0.38 wt %;
a content of silicon is 0.83 wt %;
a content of manganese is 0.41 wt %;
a content of nickel is 0.93 wt %;
a content of chromium is 22.8 wt %;
a content of niobium is 0.85 wt %;
a content of tungsten is 1.79 wt %;
a content of vanadium is 0.43 wt %;
a content of cerium is 0.08 wt %; and
a content of nitrogen is 0.07 wt %.

4. An exhaust manifold comprising the heat-resistant cast steel of claim 1.

5. An exhaust manifold comprising the heat-resistant cast steel of claim 2.

6. An exhaust manifold comprising the heat-resistant cast steel of claim 3.

7. A turbine housing comprising the heat-resistant cast steel of claim 1.

8. A turbine housing comprising the heat-resistant cast steel of claim 2.

9. A turbine housing comprising the heat-resistant cast steel of claim 3.

10. An integrated exhaust manifold turbine housing comprising the heat-resistant cast steel of claim 1.

11. An integrated exhaust manifold turbine housing comprising the heat-resistant cast steel of claim 2.

12. An integrated exhaust manifold turbine housing comprising the heat-resistant cast steel of claim 3.

* * * * *